US010568795B2

(12) United States Patent
Sanchez Martinez et al.

(10) Patent No.: US 10,568,795 B2
(45) Date of Patent: Feb. 25, 2020

(54) MASSAGE DEVICE

(71) Applicant: Braun GmbH, Kronberg (DE)

(72) Inventors: Pedro Sanchez Martinez, Kronberg (DE); Frank Kellner, Bad Hersfeld (DE); Michael Jöst, Obertshausen (DE)

(73) Assignee: Braun GMBH, Kronberg (DE)

( * ) Notice: Subject to any disclaimer, the term of this patent is extended or adjusted under 35 U.S.C. 154(b) by 445 days.

(21) Appl. No.: 15/379,758

(22) Filed: Dec. 15, 2016

(65) Prior Publication Data

US 2017/0172834 A1 Jun. 22, 2017

(30) Foreign Application Priority Data

Dec. 22, 2015 (EP) ..... 15202026.9
Nov. 23, 2016 (EP) ..... 16200353.7

(51) Int. Cl.
*A61H 1/00* (2006.01)

(52) U.S. Cl.
CPC ..... *A61H 1/008* (2013.01); *A61H 2201/0207* (2013.01); *A61H 2201/0214* (2013.01)

(58) Field of Classification Search
CPC ..... A61H 7/005; A61H 2201/149; F16D 2125/32
See application file for complete search history.

(56) References Cited

U.S. PATENT DOCUMENTS 6,537,236 B2 * 3/2003 Tucek ..... A61H 1/008 601/101
9,345,633 B2 * 5/2016 Fuhr ..... A61H 1/008
2003/0195443 A1 * 10/2003 Miller ..... A61H 1/008 601/108
2006/0010625 A1 * 1/2006 Tapper ..... A61H 7/005 15/97.1
2006/0135891 A1 * 6/2006 Jordan ..... A46B 13/008 601/20
2008/0234611 A1 * 9/2008 Sakai ..... A61H 7/005 601/95
2009/0306577 A1 * 12/2009 Akridge ..... A61M 35/003 604/20
2011/0040235 A1 * 2/2011 Castel ..... A61F 7/00 604/20
2012/0253246 A1 10/2012 Yamazaki et al.
2014/0121577 A1 5/2014 Ma et al.
(Continued)

FOREIGN PATENT DOCUMENTS

BE 1020090 4/2013
DE 813751 9/1951
(Continued)

OTHER PUBLICATIONS

English Machine Translation for foreign patent document FR3019986A1 to Befve et al. (Year: 2015).*
(Continued)

*Primary Examiner* — Timothy A Stanis
*Assistant Examiner* — Charles M Vivian
(74) *Attorney, Agent, or Firm* — Kevin C. Johnson

(57) ABSTRACT

The present invention is concerned with a massage device having a drive unit for generating a translational back-and-forth movement of the applicator along a first axis having an amplitude of 0.2 mm to 1.5 mm. The amplitude can be varied between two different operation modes of the device.

12 Claims, 3 Drawing Sheets

(56) References Cited

U.S. PATENT DOCUMENTS

| | | | | |
|---|---|---|---|---|
| 2015/0005682 | A1* | 1/2015 | Danby | A61H 23/0254 601/101 |
| 2015/0132041 | A1* | 5/2015 | Muraki | A61H 7/005 401/4 |
| 2015/0265825 | A1* | 9/2015 | Miller | A61H 23/02 604/20 |
| 2017/0281459 | A1* | 10/2017 | Cirillo-Schmidt | A61H 19/44 |

FOREIGN PATENT DOCUMENTS

| | | | | |
|---|---|---|---|---|
| FR | 3019986 | | 10/2015 | |
| FR | 3019986 | A1 * | 10/2015 | A61H 23/0263 |
| JP | S60109429 | | 6/1985 | |
| JP | 2013/173013 | | 9/2013 | |
| WO | WO2013153500 | | 10/2013 | |

OTHER PUBLICATIONS

European search report dated Jun. 24, 2016.
PCT International Search Report with Written Opinion in corresponding Int'l Appln. PCT/IB2016/057659 dated Feb. 21, 2017.

* cited by examiner

MASSAGE DEVICE

FIELD OF THE INVENTION

The present invention is concerned with a massage device for the treatment of skin, the device comprising a body and an applicator for contacting the skin of a user. The applicator is mounted on the body. A drive unit is provided for generating a translational back-and-forth movement of the applicator along an axis.

BACKGROUND OF THE INVENTION

It is known that cosmetic or massage devices perform a relative movement with respect to the skin of a user, for example for massage purposes, for applying substances to the skin and/or for removing hairs or substances from the skin.

WO 2014/009278 A1 discloses a cosmetic device comprises a rotating end piece, rotating at a speed of 150 to 400 rpm. The end piece has a profile in cross section in a plane containing the rotation axis which varies during rotation. This has the effect of alternating the pressure on the skin during rotation.

Further, WO 2014/009282 A2 suggests a cosmetic device comprising an end piece having a first base with a transverse axis comprising an upstanding element and a second base with a transverse axis comprising an upstanding element. The device further comprises a first means for setting the first base in vibratory motion along the axis and a second means for setting the second base in motion relative to a body. The device may comprise a regulating member allowing the user to regulate the frequency and/or amplitude of vibrations, and/or to regulate the orientation of the vibrations. The vibration frequency is disclosed as being greater than or equal to 20 Hz. The vibration amplitude of the applicator during application is disclosed as being less than or equal to 5 mm, or less than or equal to 3 mm.

In addition, WO 2015/086334 A1 discloses a device for applying a cosmetic product comprising an applicator driven to perform a translational back and forth movement at a frequency between 5 and 50 Hz and at an amplitude between 2 mm and 20 mm. A similar electric makeup brush is disclosed in WO 2013/077284 A1 suggesting that the reciprocal oscillation amplitude is 2-10 mm and the reciprocal oscillation frequency is 3-50 Hz.

It is an object of the present disclosure to provide an improved massage device suitable for the treatment of a user's skin and/or for applying substances to the skin.

SUMMARY OF THE INVENTION

In accordance with one aspect there is provided a massage device for the treatment of skin comprising a body and one single applicator for contacting the skin of a user, which is detachably mounted on the body. A drive unit is provided for generating a translational back-and-forth movement of the applicator along a first axis. The back-and-forth movement of the applicator, i.e. the movement of the applicator in a direction vertical to the skin during use of the device, while it passes from its rest position, that is to say when the applicator is in its most retracted position, to its end-of-travel position along the first axis has an amplitude of movement of the applicator of 0.2 mm to 1.5 mm. Surprisingly, it has been found that perfusion in the skin and subcutaneous layers may be increased by applying a stimulation with an amplitude of 0.2 mm to 1.5 mm, preferably of 0.2 mm to less than or equal to 1.0 mm.

In accordance with one aspect of the invention, the drive unit comprises an electric motor provided in the body and coupled to a means for converting the rotational movement of an output member of the motor about a second axis into a translational back-and-forth movement of the applicator along the first axis. The provision of an electric motor has the benefit of using a well-known technique in this field with the space available in the body or handle of the device being sufficient for housing an electric motor and a power supply, like a rechargeable battery.

If the applicator is electrically driven to perform a rotational movement about the first axis, the applicator and the body or a head mounted on the body may comprise corresponding guiding faces for generating a movement of the applicator along the first axis upon rotation of the applicator about the first axis. As an alternative, the drive unit may be a solenoid drive comprising magnets for generating the back-and-forth movement of the head with respect to the base.

It has been found that the back-and-forth movement of the applicator or head along the first axis causes an improved perfusion in the skin and subcutaneous layers if the frequency of the movement of the applicator is between 20 Hz and 40 Hz, preferably between 20 and 28 Hz. The frequency of the movement of the head may be variable, for example by providing different modes with a different frequency. In addition or as an alternative, different modes may be provided for varying the amplitude of the movement of the applicator.

According to a further aspect of the present invention, the body has an elongated shape and is to be used as a grip for the device. The electric motor may be provided within the body such that the second axis, which is the rotation axis of the motor output shaft, is substantially parallel to the main axis of the body. To facilitate use of the device the applicator may be positioned inclined with respect to the body.

For example, in one embodiment, the first axis and the second axis may be arranged inclined with respect to each other by an angle between 20° and 70°, preferably between 30° and 60°, e.g. about 45°. Preferably, an angle between the first axis and the second axis is less than 30°. Most preferably, the first axis and the second axis are substantially parallel or parallel to each other. By this, undesired torsional moments of the massage device due to the back-and-forth movement in combination with inertia and the counterforce of the skin with respect to the center of gravity of the massage device can be reduced. This results in a more comfortable use of the massage device.

As an alternative, the face of the applicator contacting a user's skin may be inclined with respect to the main axis of the body by 20° to 70°, whereas the back-and-forth movement of the applicator is substantially parallel with the main axis of the body and/or the second axis (motor axis).

According to an exemplary embodiment the means for converting the rotational movement of the output member into a translational movement of the applicator comprises a disc rotationally coupled to the motor and rotatable about the second axis, a first bearing eccentrically positioned on the disc, a second bearing coupled to the applicator and positioned eccentrically with respect to the second axis and a stem coupled with one end to the first bearing and with the opposite end to the second bearing. Rotation of the disc by the electric motor causes a variation of the distance between the first bearing and the second bearing. With the stem arranged between the first bearing and the second bearing, this results in an oscillating movement of the second bearing which corresponds to the back-and-forth movement of the applicator. Preferably, the movement of the head is an oscillating movement.

The means for converting the rotational movement of the output member into the translational movement of the applicator may further comprise at least one elastically deformable element, preferably a spring arrangement, biasing the second bearing towards the disc and/or the first bearing. In other words, the second bearing with the applicator are pushed by the elastically deformable element into a retracted position whereas the stem pushes the applicator and the second bearing against the bias of the elastically deformable element into an extended position depending on the angular position of the first bearing and the disc with respect to the second bearing. In addition or as an alternative the stem could be coupled with the first bearing and with the second bearing such that the stem retracts the second bearing and the applicator depending on the angular position of the first bearing and the disc. Said means can be used for converting a rotational movement of the output member about the second axis into the translational movement of the applicator along the first axis even when the second axis and the first axis are parallel, or substantially parallel to each other.

The amplitude of the movement of the applicator may be varied between two different operation modes of the device, preferably a first operation mode with a first amplitude of about 0.2 mm and a second operation mode with a second amplitude of about 1.0 mm. Most preferably, the first amplitude is between 0.2 and 0.4 mm and the second amplitude is between 0.8 mm and 1 mm. Therefore, the amplitude can be adjusted to individual preferences of the user and/or to specific types of application of the device. In addition, further operation modes for varying the amplitude of the movement of the applicator may be provided.

A variation of the amplitude may be effected by providing means for limiting the amplitude of movement of the applicator in the device. The means for limiting the amplitude of the movement of the applicator may be provided in addition to the means for converting the rotational movement of the output member into the translational movement of the applicator. A mechanical limitation may be provided for the embodiment with the applicator being driven by the electric motor, whereas a mechanical or a different type of limiter may be used for the embodiment with the solenoid drive.

A limiter for limiting the amplitude of the movement of the applicator may be provided, wherein the first operation mode corresponds to a first position and/or state of the limiter and the second operation mode corresponds to a second position and/or state of the limiter. In a preferred embodiment, switching between the first mode and the second mode is performed by moving the limiter between the first position and the second position. Most preferably, the first position is a first rotational position and the second position is a second rotational position regarding a rotation of the limiter about the second axis.

For example, the means for limiting the amplitude of movement of the applicator may comprise a limiter limiting the displacement of the second bearing towards the disc and/or the first bearing under the action of the at least one elastically deformable element. This may require that at least one of the bearings is designed as a floating bearing allowing relative movement of the stem with respect to the bearing in the direction of the longitudinal axis of the stem. For example, at least one of the bearings may be designed as a bearing shell or a bearing sleeve. Preferably, the limiter is designed such that retraction of the applicator with respect to the body is limited, whereas the extended position of the applicator with respect to the base is identical for the first operation mode with the reduced amplitude and the second operation mode with the increased amplitude. In particular, the limiter may limit the displacement of the second bearing along the second axis.

In more detail, the second bearing may be coupled to a contact surface. Further, the limiter may comprise a first counter contact surface and a second counter contact surface being spaced from the contact surface by a different amount with the limiter moveable with respect to the base between a position in which the counter contact surface abuts the first counter contact surface under the action of the at least one elastically deformable element and a position in which the contact surface abuts the second counter contact surface under the action of the at least one elastically deformable element. For example, the movement of the limiter may be a rotation of the limiter, e.g. substantially without movement of the limiter parallel to the second axis. As an alternative, the limiter may have a single counter contact surface with the limiter being moved for example substantially parallel to the second axis thereby varying the distance between the contact surface and the counter contact surface.

In an embodiment, the first bearing and the second bearing comprise a spherical cap recess portion, respectively. The first end and/or the second end of the stem may comprise a corresponding spherical cap portion or a spherical segment portion for engagement with the respective spherical cap recess portion. This ensures adequate flexibility of the relative movement between the stem and the first bearing and/or the second bearing. Most preferably, the stem is substantially of the shape of a cylindrical rod, wherein its first end and second ends are formed as hemispheres, respectively.

In a preferred embodiment, the spherical cap recess portion of at least one of the first bearing or the second bearing may be provided as a non-retaining spherical cap recess portion which has a shape of less than a hemisphere. Therefore, the spherical cap portion of the stem guided in said bearing can slide out of contact with the non-retaining spherical cap recess portion, if necessary. This results in a floating bearing allowing sufficient flexibility of the stem with respect to the bearing in the direction of the longitudinal axis of the stem. A tapered recess portion narrowing towards the non-retaining spherical cap recess portion may be joined to said non-retaining spherical cap recess portion.

The noise generated by the device may be reduced by providing a damping element, for example arranged between the base and the head. In more detail, the at least one damping element may be provided between the contact surface of the head and the counter contact surface(s) of the limiter. For example, the at least one damping element may be made of an elastomer material. Most preferably, the at least one damping element is an elastomer buffer.

In an embodiment, a switch, for example a sliding switch, for switching between the first mode and the second mode is provided on the outside of the body. The switch may be coupled to the limiter such that operation of the switch causes the limiter to move from the first position to the second position and vice versa.

The massage device of the present invention may be used for different purposes. Thus, it is preferred if the applicator is detachably mounted on the body, for example by means of a head mounted on the body. The head may be detachably mounted on the body and/or the applicator may be detachably mounted on the head. A variety of different types of heads and/or applicators may be provided for attachment to the body depending on the desired use of the device. The applicator may comprise a metal plate, bristles, a heating element, a cooling element or a combination thereof. Further, the head and/or the applicator may comprise a dispenser for substances to be applied to the user's skin.

According to an independent preferred aspect of the present invention, the massage device comprises a head which is gimbal mounted on the body and/or comprises a head with an applicator which is gimbal mounted on the head. This allows smooth adaption of the applicator and/or the head to the contour of the user's skin. In addition or as an alternative, the head and/or the applicator may be provided in a floating manner on the body allowing adaption to the contour of a user's skin. According to a preferred embodiment, the applicator is releasably attached to the head or the body with the applicator comprising an application surface suitable for contacting a user's skin, a drive element suitable for transmitting movements from the head and/or the body to the application surface and a gimbal interposed between the application surface and the drive element of the applicator. In other words, the gimbal is preferably a part of the exchangeable applicator. The drive element may be a separate part of the applicator or may be an integral part of the gimbal, for example at least one pin suitable to be clipped into a respective counter-element of the head or the body.

Preferably, the device further comprises an elastically deformable element for biasing the head and/or the applicator into a home position. The head and/or the applicator may be deflected from the home position against the bias of the elastically deformable element. For example, the elastically deformable element may be a compression spring.

In addition to the movement along the first axis the head and/or the applicator may be rotated about the first axis. For example, the head and/or the applicator may be electrically driven to perform an oscillating rotational movement.

Further details and features of the invention may be obtained from the following description of embodiments in conjunction with the drawings.

DETAILED DESCRIPTION OF THE INVENTION

Figure 1A:
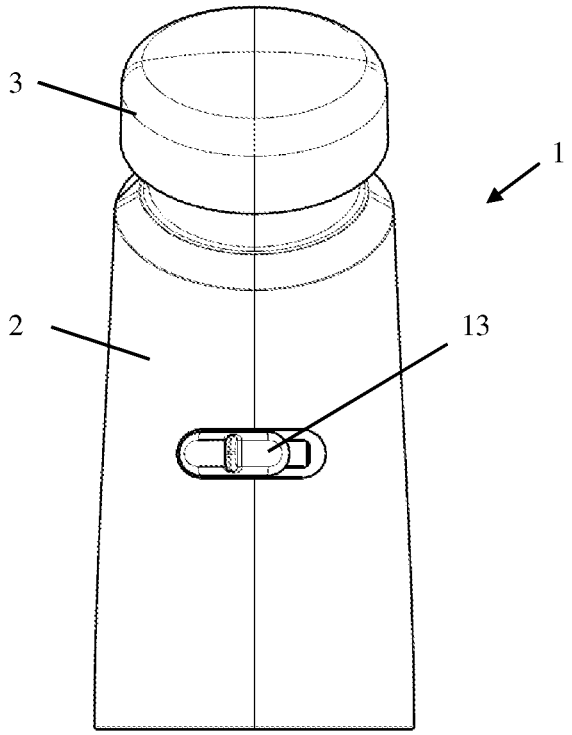
FIG. 1*a* is a side view on the head of a massage device according to an embodiment of the invention.
Figure 1B:
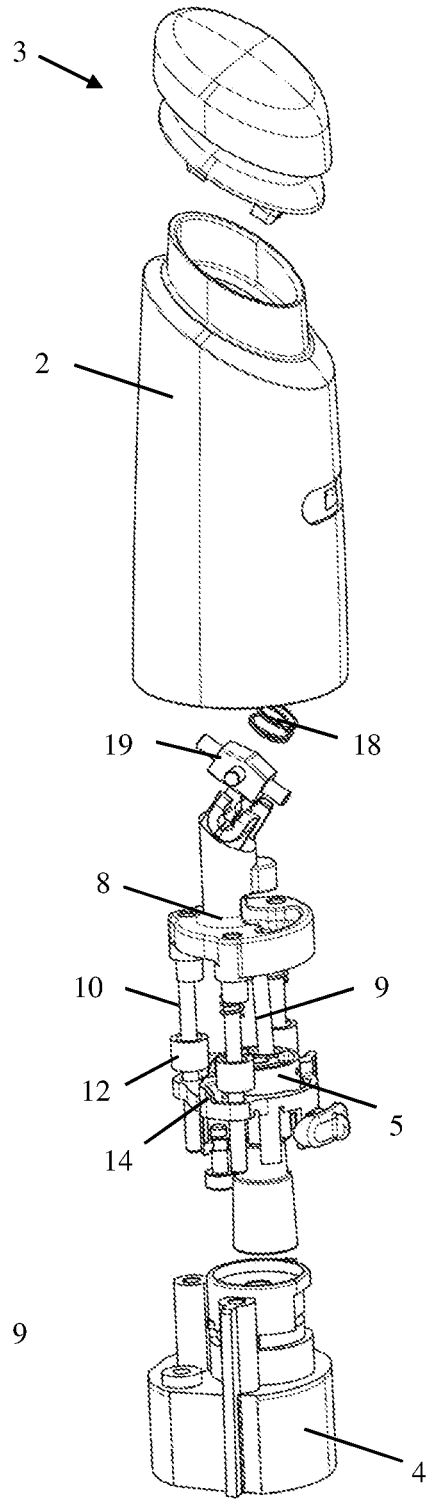
FIG. 1*b* is an exploded view of the component parts of the massage device of FIG. 1*a*.
Figure 1C:
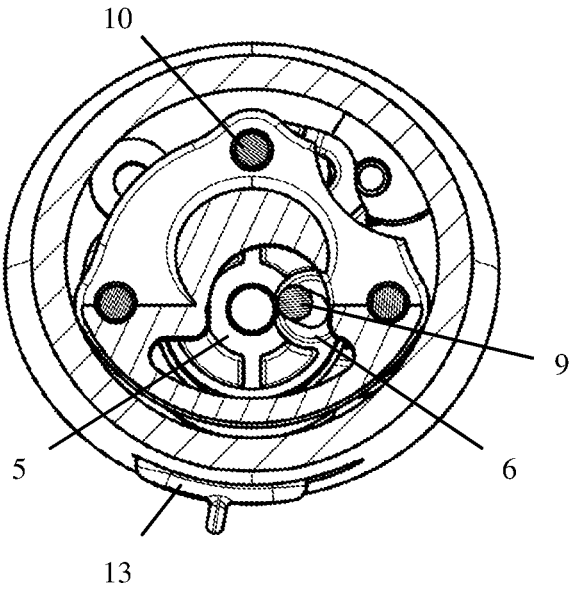
FIG. 1*c* is a sectional view of the device of FIG. 1*a* in a plane perpendicular to the main axis.
Figure 1D:
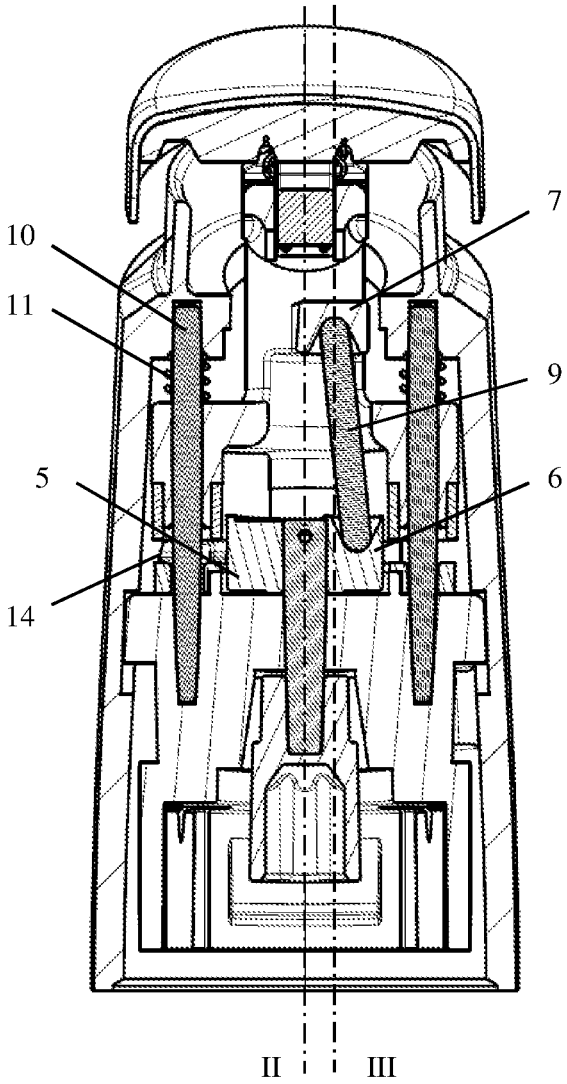
FIG. 1*d* is a sectional view of the device of FIG. 1*a* in a plane parallel to the main axis.

FIG. 1*a* to 1*e* show the upper portion of a massage device 1 according to a first embodiment of the invention. The device 1 comprises a body (not shown), a head 2 which is typically detachably mounted on the body and an applicator 3 which is mounted on or in the head 2. The body is typically an outer housing which may form a handle for gripping the device 1 during use. The purpose of the device is to provide a tapping or vibrating massage movement of the applicator 3 with respect to the body. As can be seen from FIG. 1*e*, the applicator 3 is positioned inclined with respect to head 2 and the body. In more detail, a first central axis I of the applicator 3 forms an angle of about 45° with a second axis II defined as the rotational axis of the shaft of an electric motor 4 contained within the body or with respect to a third axis III parallel to the main extension of the elongate body (FIG. 1*d*). In particular, a face of the applicator 3 for contacting a user's skin is inclined with respect to the main axis III of the body by about 45°. The tapping or vibrating movement of the applicator 3 with respect to the body occurs along the first axis I in the embodiment of FIGS. 2 and 3 and along the second axis II or along the third axis III in the embodiment of FIG. 1*a* to 1*e*.

The drive mechanism for generating the tapping or vibrating movement of the applicator 3 is now explained with reference to FIG. 1*a* to 1*e* in more detail. The output drive shaft of the motor 4 is rotationally constrained to a disc 5. The disc 5 is provided with a first bearing 6 in the form of a bearing sleeve or bearing shell which is located eccentrically with respect to the axis of rotation of the disc 5, i.e. substantially the second axis II. A second bearing 7 which may also have the form of a bearing sleeve or bearing shell is provided in a frame 8 of the head 2 or the applicator 3. The second bearing 7 is eccentrically located with respect to the axis of rotation of the disc 5. Axis III in FIG. 1*d* indicates the offset between the second bearing 7 and the second axis II of disc 5. A stem 9 is arranged between the first bearing 6 and the second bearing 7. In the embodiment depicted in FIG. 1*a* to 1*e* the stem 9 is received at least in one of the first bearing 6 or the second bearing 7 in a floating manner allowing to partly remove the stem from the bearing while still being in engagement with the bearing. In other words the stem 9 remains in contact with the sidewall of the respective bearing, whereas the tip of the stem may lose contact with the base portion of a shell-type bearing.

The frame 8 is mounted on the body by means of pins 10 of the body guiding the frame 8 in a floating manner. Further, compression springs 11 are provided for biasing the frame downwards in FIGS. 1*d* and 1*e*, i.e. towards the body. This keeps the stem 9 in contact with the bearings 6, 7.

Actuation of the electric motor 4 causes the disc 5 to rotate. Thus, bearing 6 is rotated together with disc 5. The offset, i.e. the eccentric arrangement of the bearings 6, 7 result in a different inclination of stem 9 with respect to the body depending on the angular position of the bearing 6 with respect to the body. In other words, rotation of the disc 5 causes the stem 9 to periodically change from a substantially vertical orientation (FIG. 1*d*) to a more inclined orientation if disc 5 is rotated 180° (not shown) with respect to the position of FIG. 1*d*. In conjunction with the compression springs 11 this results in an oscillating movement of the frame 8 due to the stem 9 pushing the frame 8 upwards against the bias of springs 11 and by the springs 11 pushing the frame 8 back downwards. A damper 12 is provided for each pin 10 reducing the noise generating during the oscillating movement of the applicator.

Figure 1E:
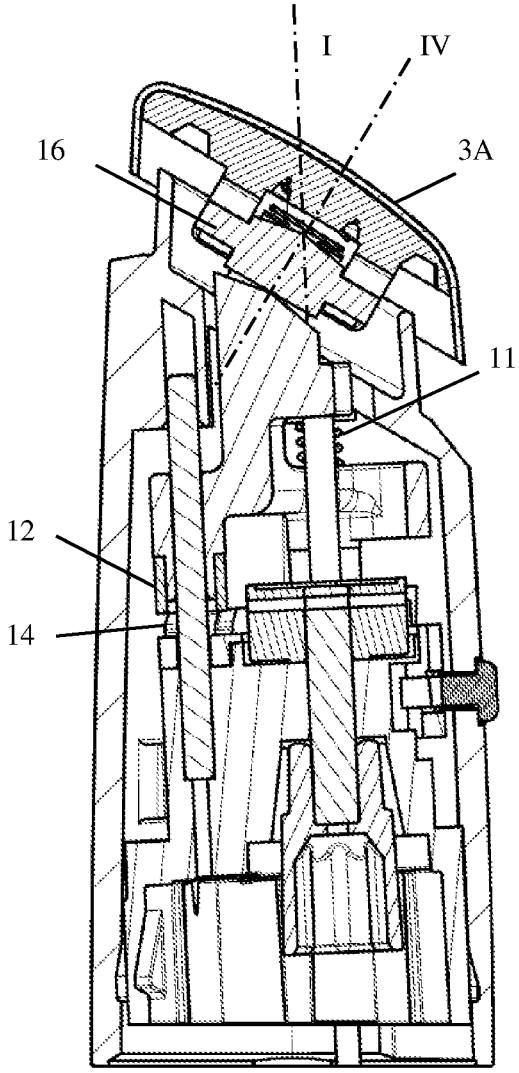
FIG. 1*e* is a further sectional view of the device of FIG. 1*a* in a plane parallel to the main axis.

In the embodiment of FIG. 1*a* to 1*e* the amplitude of the movement of the applicator 3 may be changed between two different modes of operation. A switch 13 is provided which is coupled to a ring having a ramp 14. The ring is mounted within the body to allow rotation under the action of switch 13. The dampers 12 provide a contact surface interacting with respective counter contact surfaces on the ring with ramp 14. As can be seen in FIGS. 1*b*, 1*d* and 1*e* the ramp 14 defines counter contact surfaces with a different distance to the contact surface of the damper 12. In other words, the distance available for the plunging movement of frame 8 along pins 10 may be limited depending on the position of ramp 14. For example, the amplitude of the movement of applicator 3 is 1.0 mm in the position of ramp 14 as shown in FIGS. 1*d* and 1*e* and may be limited to 0.2 mm by rotating ramp 14 into engagement with the dampers 12.

Figure 2:
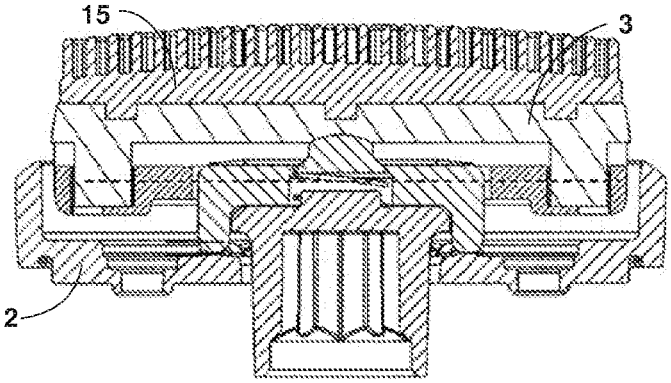
FIG. 2 is a sectional view of the applicator for a massage device according to the invention.
Figure 3:
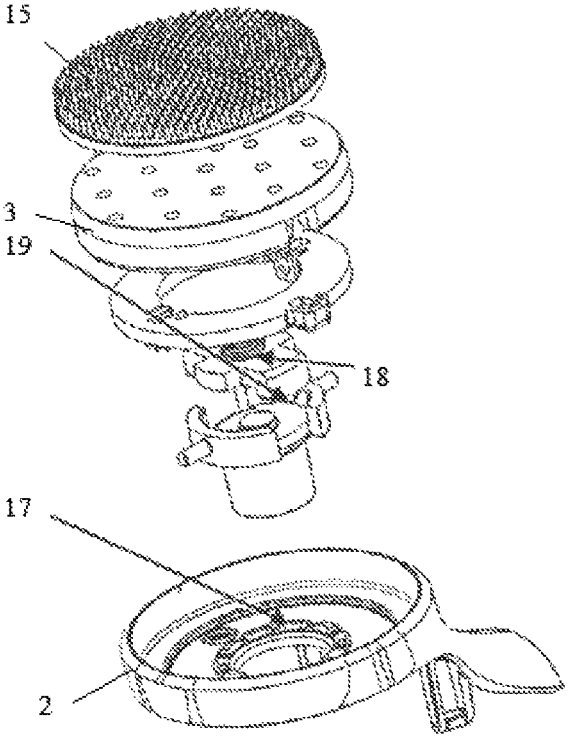
FIG. 3 is an exploded view of the applicator of FIG. 2.

A further embodiment of an applicator of the massage device 1 according to the invention is depicted in FIGS. 2 and 3. As can be seen in FIG. 3 the applicator 3 is gimbal mounted in head 2 by providing two pivotable bearings arranged perpendicular to each other on gimbal element 19. This allows swiveling of the applicator 3 with respect to head 2 and body. Further, FIG. 3 shows that the applicator 3 comprises a main part onto which a pad 15 with a plurality of bristles or nubs for contacting a user's skin is attached.

In the embodiment of FIG. 3 the tapping or vibrating movement of the applicator 3 is generated by providing ribs 16 on a portion of the gimbal mounting of the applicator and corresponding ramps 17 in a counter surface of head 2. Further, the applicator 3 is driven to rotate about its first axis I. A compression spring 18 is provided interposed between the applicator 3 and the head 2, thereby pushing ribs 16 into engagement with ramps 17. This causes an oscillating movement of the applicator 3 along the first axis 1 upon rotation of the applicator 3. The spring 18 further assists in holding the applicator in a home position as shown in FIG. 2. The applicator 3 may be deviated from this home position due to its gimbal mounting in the head 2 against the bias of spring 18.

Figure 4:
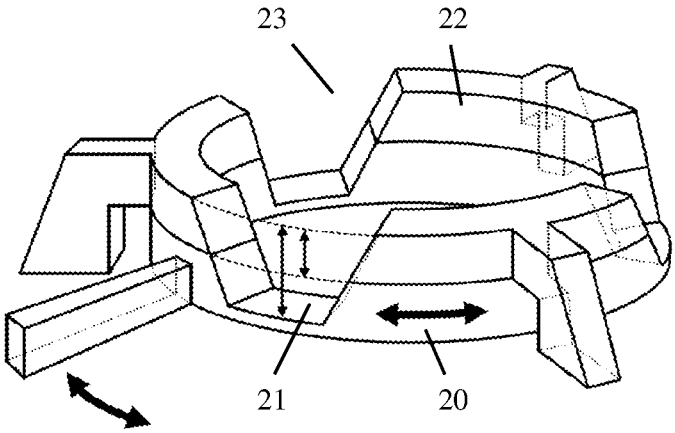
FIG. 4 is a schematic perspective view of means for switching between two modes in the applicator of FIGS. 2 and 3.

FIG. 4 shows a subassembly which is omitted in FIG. 2 and FIG. 3 but which may be interposed e.g. between ribs 16 and ramps 17 or which may replace ramps 17. The subassembly comprises a first ring 20 having several recesses 21. The subassembly further comprises a second ring 22 with openings 23, i.e. a similar configuration as ramps 17. The first ring 20 may be rotationally constrained in head 2. As an example, ring 20 is provided with lateral legs which may retain ring 20 in head 2. The second ring 22 is rotatable with respect to the first ring 20 as indicated by the arrow in FIG. 4. For example, a handle may be provided fixed to the second ring 22 for rotating ring 22 relative to fixed ring 20. FIG. 4 shows a situation where recesses 21 are aligned with openings 23. This means that the applicator may move with a larger amplitude with ribs 16 engaging recesses 21 and openings 23. However, with the second ring 22 rotated relative to the first ring 20 such that recesses 21 are not aligned with openings 23, the ribs 16 only engage openings 23 of the second ring 22 without engaging recesses 21 of the first ring which are shielded by the second ring 22. This limits the amplitude of the ribs 16.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A massage device for the treatment of skin comprising a body and an applicator for contacting the skin of a user, which is mounted on the body, wherein a drive unit is provided for generating a translational back-and-forth movement of the applicator along a first axis, wherein the back-and-forth movement of the applicator while it passes from its rest position, that is to say when the applicator is in its most retracted position, to its end-of-travel position along the first axis has an amplitude of movement of the applicator of about 0.2 millimeters to about 1.5 millimeters, characterized in that the amplitude of the movement of the applicator can be varied between two different operation modes of the massage device, wherein the drive unit comprises an electric motor provided in the body and coupled to a means for converting the rotational movement of an output member of the motor about a second axis into the translational back-and-forth movement of the applicator along the first axis, wherein the means for converting the rotational movement of the output member into the translational back-and-forth movement of the applicator comprises a disc rotationally coupled to the motor and rotatable about the second axis, a first bearing eccentrically positioned on the disc, a second bearing coupled to the applicator and positioned eccentrically with respect to the second axis and a stem coupled with one end to the first bearing and with the opposite end to the second bearing, wherein the means for limiting the amplitude of movement of the applicator comprises a limiter limiting the displacement of the second bearing towards the disc or the first bearing under the action of the at least one elastically deformable element, and wherein the second bearing is coupled to a contact surface and that the limiter comprises a first counter contact surface and a second counter contact surface being spaced from the contact surface by a different amount, with the limiter being movable with respect to the body between a position in which the contact surface abuts the first counter contact surface under the action of the at least one elastically deformable element and a position in which the contact surface abuts the second counter contact surface under the action of the at least one elastically deformable element.

2. The device in accordance with claim 1, wherein a first operation mode with a first amplitude of the translational back-and-forth movement of the applicator is in the range of between about 0.2 millimeters and about 0.4 millimeters and a second operation mode with a second amplitude is in the range of between about 0.8 millimeters and about 1.0 millimeters.

3. The device in accordance with claim 2, wherein the first amplitude is about 0.2 millimeters and wherein the second amplitude is about 1.0 millimeters.

4. The device in accordance with claim 1, wherein the translational back-and-forth movement of the applicator along the first axis has a frequency between 20 Hz and 40 Hz.

5. The device in accordance with claim 1, wherein the body has an elongated form extending along a third axis, wherein the first axis and the third axis are arranged inclined with respect to each other by an angle between about 20° and about 70°.

6. The device in accordance with claim 5, wherein the back-and-forth movement of the applicator is substantially parallel with the third axis.

7. The device in accordance with claim 1, wherein the means for converting the rotational movement of the output member into the translational back-and-forth movement of the applicator further comprises at least one elastically deformable element biasing the second bearing towards the disc or the first bearing.

8. The device in accordance with claim 1 further comprising means for limiting the amplitude of movement of the applicator.

9. The device in accordance with claim 1 further comprising a damping element arranged between the body and the applicator.

10. The device in accordance with claim 1, wherein the applicator is gimbal mounted on the body or on a head which is mounted on the body.

11. The device in accordance with claim 10, further comprising an elastically deformable element for biasing the applicator into a home position.

12. The device in accordance with claim 1, wherein the applicator comprises at least one of a metal plate, a metal shell, bristles, nubs, a heating element, a cooling element, a dispenser or a pad.

* * * * *